US005921421A

United States Patent [19]

Fuquan

[11] Patent Number: 5,921,421

[45] Date of Patent: Jul. 13, 1999

[54] BLADDER-TYPE MULTIPURPOSE VESSEL

[76] Inventor: Liang Fuquan, Room 104, Bldg. 4, Nanfengli, Baidilu, Nankai, District Tianjin 300193, China

[21] Appl. No.: 08/737,001

[22] PCT Filed: Apr. 26, 1995

[86] PCT No.: PCT/CN95/00031

§ 371 Date: Mar. 3, 1997

§ 102(e) Date: Mar. 3, 1997

[87] PCT Pub. No.: WO95/29091

PCT Pub. Date: Nov. 2, 1995

[30] Foreign Application Priority Data

Apr. 26, 1994 [CN] China ..... 94104501

[51] Int. Cl.[6] ..... B63B 25/00

[52] U.S. Cl. ..... 220/1.6; 114/74 R

[58] Field of Search ..... 220/461, 495.01, 220/1.6; 114/74 R, 74 A, 75

[56] References Cited

U.S. PATENT DOCUMENTS

| | | | |
|---|---|---|---|
| 2,696,185 | 12/1954 | Snoddy | 114/74 R |
| 2,966,040 | 12/1960 | Henry | 114/74 A |
| 3,101,861 | 8/1963 | Mearns, III et al. | 114/74 A |
| 3,356,251 | 12/1967 | Roberts . | |
| 3,385,251 | 5/1968 | Grocott | 114/125 |
| 3,707,937 | 1/1973 | Liles | 114/74 R |
| 3,922,985 | 12/1975 | Hamilton | 114/74 R |
| 4,230,061 | 10/1980 | Roberts et al. | 114/74 A |
| 4,389,959 | 6/1983 | Conway | 114/74 R |
| 5,031,558 | 7/1991 | Davis | 114/74 R |
| 5,203,828 | 4/1993 | Strain | 114/74 R |
| 5,363,787 | 11/1994 | Konopasek et al. | 114/74 A |

FOREIGN PATENT DOCUMENTS

| | | |
|---|---|---|
| WO 92/137454 | 8/1992 | WIPO . |

*Primary Examiner*—Steven Pollard
*Attorney, Agent, or Firm*—Harness, Dickey & Pierce, P.L.C.

[57] ABSTRACT

A bladder-type multipurpose vessel which provides a novel solution to the problems that exist in current oil tankers, such as unsafety, unitary transportation function and environmental pollution. The cargo hold of the present vessel is of the construction combined by a rigid structure and a flexible one, and the crude oil lies in a quad protection of an outer shell, an inner shell, a water cushion and spray layer, and a bladder, causing its safety to be greatly increased. Since the vessel has the special cargo hold construction and corresponding facilities to make it possible to transport both oil and water as well as goods, being of outstanding applicability, economy, safety and environmental protection effect.

14 Claims, 3 Drawing Sheets

BLADDER-TYPE MULTIPURPOSE VESSEL

FIELD OF THE ART

The invention relates to a novel bladder-type multipurpose vessel.

BACKGROUND OF THE ART

Currently, when collisions, rock-strikings and the like accidents happen to oil tankers, in case that the hull cracks, plenty of crude oil will flow out of the vessel causing the environment to be polluted. To reduce the occurrence of such accidents and relieve the damage due the same, the technical measures which can presently be adopted are: crude oil is stored in separate holds in an oil tanker; double-wall shells are sued for an oil tanker and the sheet thickness of the hull is increased.

During transportation, the impurities contained in crude oil itself will partly deposit in the oil holds, so they have to be scavenged at regular intervals that corresponding hold-scavenging equipment will be needed and certain sewage will be produced after scavenging.

It is required for the oil tanker in no-load state to have a certain amount of ballasting water, a specially provided ballasting water hold does not cause any pollution, but needs to occupy a part of effective loading space; if an oil hold is used to contain the ballasting water, the water will be polluted thus requiring a corresponding treatment apparatus to be provided.

An oil tanker can often make its single-way transportation because of its unitary function of oil transportation.

DISCLOSURE OF THE INVENTION

The object of the present invention is to provide a novel multi-function vessel, which can effectively reduce the occurrence rate of oil leakage accidents and can also make the special hold-scavenging facilities and the ballasting water hold unnecessary, and which is without production of operational sewage and with the function of oil-, water- and cargo-transportation to make the vessel capable of achieving two-way transportation.

The object of the present invention is achieved in such a way: the structure of the cargo hold of such a vessel is comprised of an outer shell, a compartment (sealed), an inner shell and a bladder. On the inner shell there is provided a connecting valve, which is at ordinary times in an open state for communicating both sides of the shell, and which will be closed when the bladder cracks. The structure is a combination of a rigid structure and a flexible one. Under oil-transportation condition, the oil in the hold lies in a state of quad protection by the outer shell, the inner shell, a water cushion and a spray layer. Once an accident of collision occurs, the energy of collision is substantially applied to the two tiers of rigid structures, the outer and inner shells, while the bladder is exerted by a very small force, even large deformation takes place, it cannot crack. The water cushion and the spray layer (above the surface of water cushion and below the spray pipe) between the bladder and the outer shell can effectively prevent fire-making due to the collision. The external pressure provided by the water cushion to the bladder can also balance out most of the internal pressure provided by the crude oil to the bladder. Under water-transportation condition, the water can be injected directly to the cargo hold of rigid structure. By drawing out the water from the cargo hold and drawing in the bladder through a lifting cable to put it at the upper part of the cargo hold, the vessel can be used to transport various kinds of solid goods.

By adopting the above-described scheme, the vessel is caused to greatly increase the safety in relation to current oil tankers; and there being no production of operational sewage, the vessel is caused to significantly simplify the self-contained facilities; and while the strength of the hull structure is ensured, the sheet thickness of the hull can be reduced to a certain extent, thus reducing the cost of shipbuilding; and because of the particular cargo hold structure of the vessel, it is caused to have the direct functions of oil-, water- and cargo-transportation.

DESCRIPTION OF THE DRAWINGS

The present invention will be further described in the following in combination with an embodiment and attached drawings in which.

PREFERRED EMBODIMENT OF THE INVENTION

Figure 1:
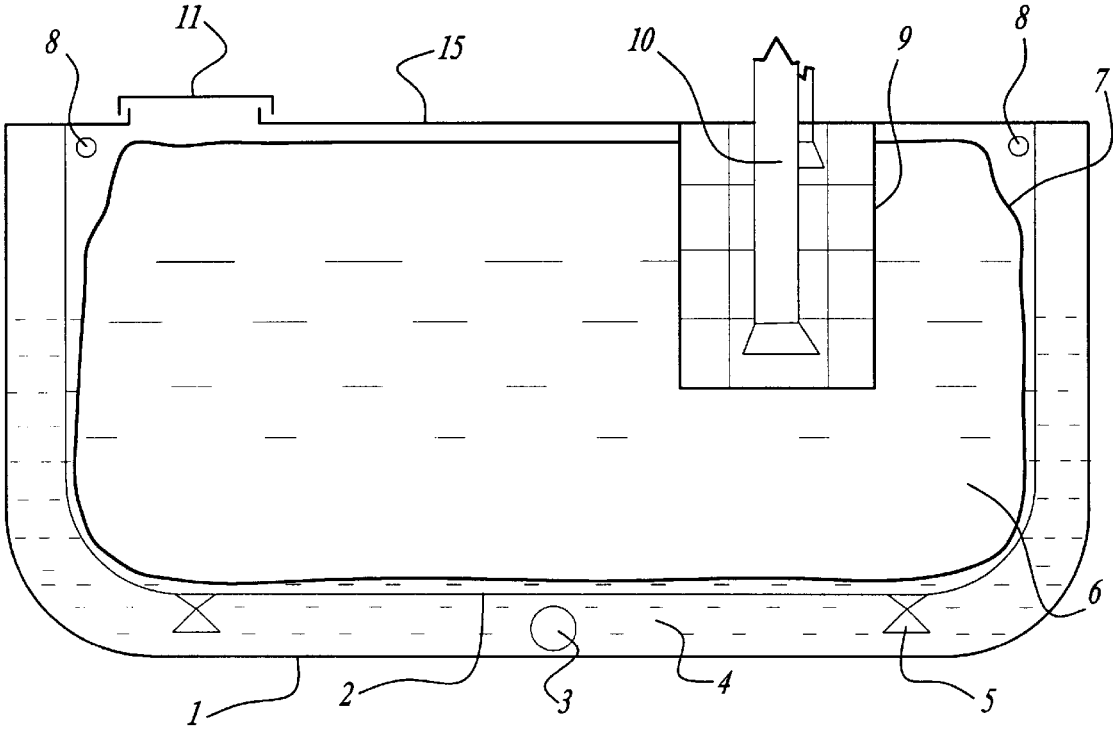
FIG. 1 is a schematic view of an embodiment of a cargo hold when in oil-transportation condition.

In the drawings there are: outer shell 1; inner shell 2; charging and discharging port of water hold 3; water hold and water cushion 4; automatic valve 5; crude oil 6; bladder 7; spray pipe 8; blocking railings 9; oil-receiving port, oil-scavenging port, fire-fighting nozzle and the like 10; hold cover 11; bladder-lifting cable 12; reserve bladder-lifting cable 13; reserve bladder 14. and upper deck 15.

In FIG. 1, cargo hold lies in the oil-transportation condition, crude oil 6 in the hold being under the quad protection of water cushion 4, spring layer (below spray pipe 8 and above water cushion 4), inner shell 2 and outer shell 1. The oil hold operating facilities, such as oil-receiving port, oil-scavenging port and fire-fighting nozzle and the like 10 enter oil hold 6 from the upper part; the crude oil under the oil-scavenging port is raised by increasing the water level in the water hold 4; and blocking railings 9 function to block the bladder not to be drawn into the scavenging port, automatic valve 5 is in a constantly open state and is closed when the bladder leaks.

The cargo hold structure of the vessel is comprised of outer shell 1, compartment (sealed), inner shell 2 (provided with a connecting valve unsealed at ordinary times) and bladder 7. On the inner shell 2 there is provided a connecting valve 5 which lies in a constantly open state at ordinary times for communicating both sides of the shell, when the bladder cracks, the valve will be closed to prevent the crude oil from leaking to the outside. The material constituting the bladder is a multi-tier composite material, being lightweight, with high strength and being hermetic; and each tier of the multi-tier fabrics are coated with a hermetic coating, the inner-most tier being an antistatic, oil-resistant one, an intermediate tier 16 being a reinforced hermetic one and the outermost tier 17 being a waterproof hermetic one. Between these tiers there are performed continuous and uncontinuous (grid type) adhesions (that is, there is an uncontinuous adhesive layer after every several continuous adhesive layers) to ensure its desirable foldability. At the upper part of the bladder wall and on the outer shell side of the vessel there is a margin of size to ensure that when the steel shell deforms rapidly, there will be no increased inner pressure caused by the crude oil against the bladder wall.

Figure 2:
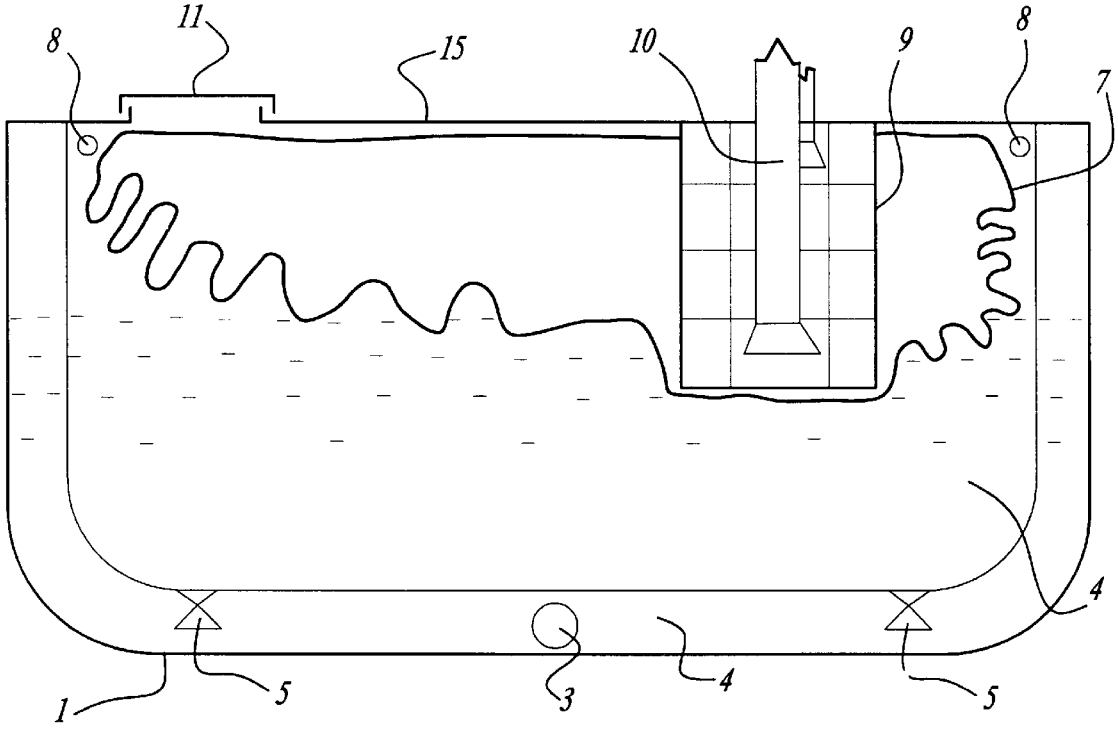
FIG. 2 is a schematic view of the embodiment of the cargo hold when in water-transportation condition.

FIG. 2 is a schematic view of the embodiment of the cargo hold when in water-transportation condition, where the bladder floats on the water surface in the cargo hold. The reception of the water in the hold is achieved by means of the charging and discharging port 3 of the water hold.

Figure 3:
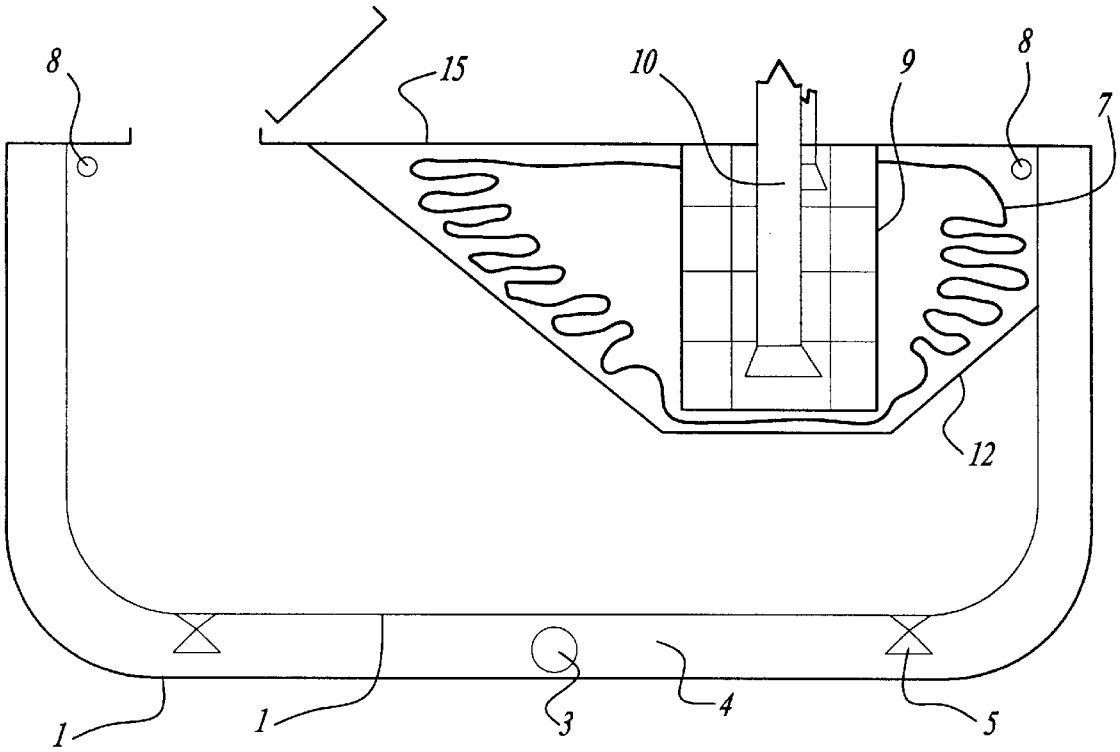
FIG. 3 is a schematic view of an embodiment of a cargo hold when in cargo-transportation condition.

FIG. 3 is a schematic view of an embodiment of the cargo hold when in oil-transportation condition, where the water in the cargo hold has been discharged out of the hold through the charging and discharging port 3 and bladder 7 is fixed on the upper part of the cargo hold through bladder lifting cable 12.

Figure 4:
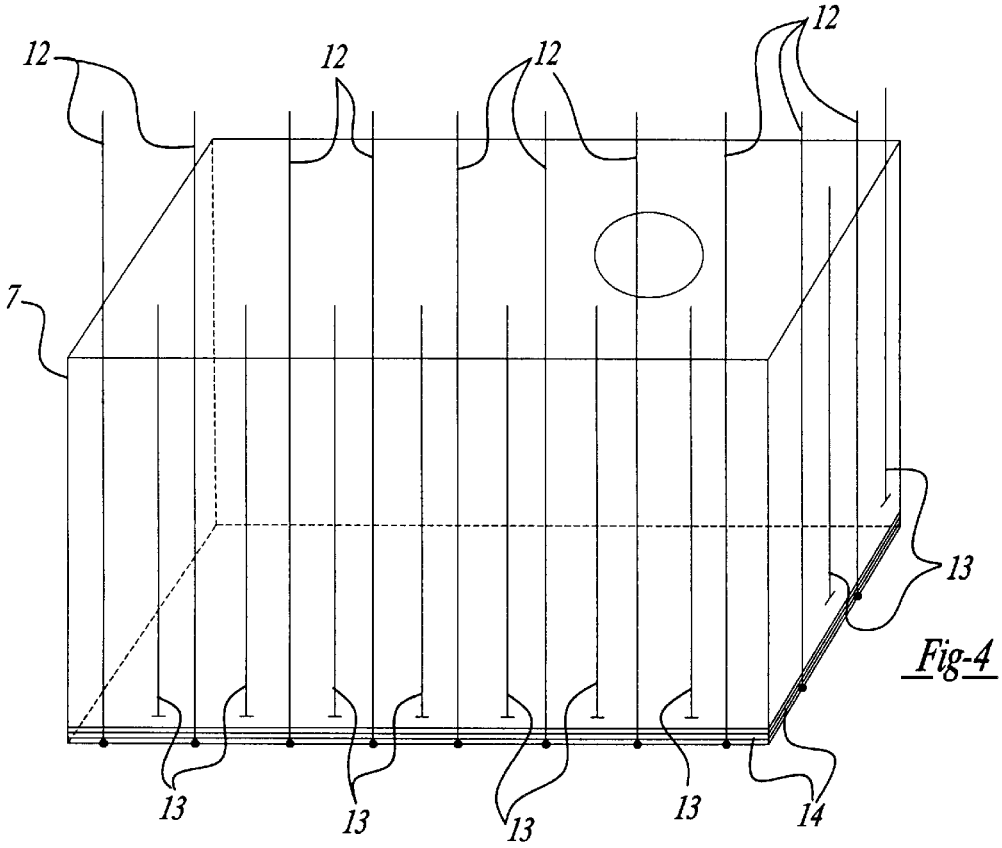
FIG. 4 is a schematic view of a bladder structure; and FIG, 5 is a section view of bladder material.
Figure 5:
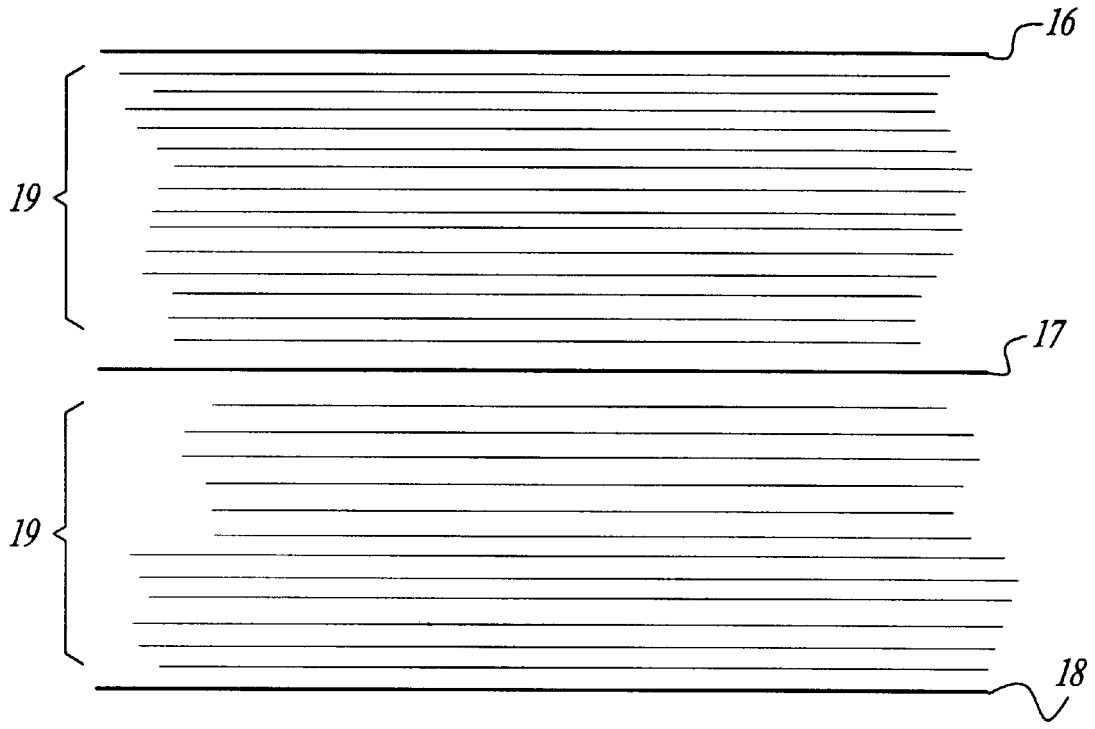

FIG. 4 is a schematic view of a bladder structure. The reserve bladder 14 is folded at the bottom of the bladder with the folding crease being adhered simply by a water-resistant adhesive of low strength, so in case the bladder cracks the reserve bladder 14 is rapidly opened with the reserve bladder-lifting cable 13 to restore the hermetic performance of the bladder.

The bladder can be ascended and descended and there is a reserve one. Around the bladder bottom there are bladder-lifting cable 12 and reserve bladder-lifting cable 13, the former 12 passing through and being fixed to the ultimate bottom of bladder 7 and the latter 13 being provided at the bottom of the side wall of the bladder and above the folding crease of the reserve bladder. At ordinary times the reserve bladder wall lies in a folded state at its bottom with the folding crease being adhered simply by an oil-resistant adhesive of low strength to ensure that once the reserve bladder-lifting cable 13 is pulled, it is convenient to cause reserve bladder 14 to be in an operating state.

Outside bladder 7 and inside outer shell 1, there is formed water cushion 4 by injecting water through charging and discharging port 3. If a water-transportation condition is to turn to an oil-transportation condition, it is all right to keep a portion of water in the rigid cargo hold beforehand.

The feature of the present invention is to use bladder 7 as a first hermetic layer, in between bladder 7 and outer shell 1 there is water cushion, and inner shell 2 now is in a passable state by means of the connecting valve. The external pressure provided by water cushion 4 is used to balance the internal pressure exerted by crude oil 6 to bladder 7. Since the specific weight of water is slightly higher than that of crude oil, the position where the bladder wall is subject to the maximum differential pressure is at the surface of water cushion 4, while the differential pressure between the external and internal pressures at the bottom of bladder 7 can be adjusted to be null.

Under the upper deck of the vessel there is provided spray pipe 8, and the water from water cushion 4 is used to spray the bladder 7 portion above the water surface to ensure that there is sufficient moisture around the bladder.

Oil-receiving port, oil-scavenging port and fire-fighting nozzle and the like 10 enter the oil hold from its upper part, being provided at the intermediate and upper part and of a flexibility in small range. To be advantageous to the loading and unloading of the crude oil, the oil level under the oil-scavenging port is raised by means of increasing the water level outside the bladder. When oil is being unloaded, water is injected through charging and discharging port 3 of the water hold to increase the water pressure of water hold 4 and the pressure is acted on crude oil 6 through bladder 7 to push upward the oil surface, causing the crude oil under the oil-receiving port to be smoothly discharged out of the hold.

This is a construction combined by a rigid structure and a flexible one. Under oil-transportation condition, the oil in the hold lies in a state of quad protection by outer shell 1, inner shell 2, water cushion 4 and spray layer, and bladder 7. Once an accident of collision and the like occurs, the energy of collision is substantially applied to the two tiers of rigid structures, the outer and inner shells, while the bladder is exerted by a very small force, even large deformation takes place, it cannot crack. Water cushion 4 and spray layer (above the surface of water cushion 4 and below spray pipe 8) between bladder 7 and outer shell 1 can effectively prevent fire-making due to the collision. The external pressure provided by water cushion 4 to bladder 7 can also balance out most of the internal pressure provided by crude oil 8 to bladder 7. Under water-transportation condition, the water can be injected directly to the cargo hold of rigid structure (see FIG. 2). By drawing out the water from the cargo hold and drawing in bladder 7 through bladder-lifting cable 12 to put it at the upper part of the cargo hold, the vessel can be used to transport various kinds of solid goods (see FIG. 3). Industrial Applicability The bladder-type multipurpose vessel of the present invention has the special cargo hold construction and corresponding facilities to make it possible to transport both oil and water as well as goods, being of outstanding applicability, economy, safety and environmental protection effect.

What is claimed is:

1. A bladder-type multipurpose vessel operable to transport oil, water, or solid cargo, the vessel comprising:

an outer shell;

a deck fitted substantially to said outer shell;

an inner shell substantially spaced apart from said outer shell such that a space for holding water is defined therebetween, said space defining a water cushion, said inner shell including a floor and a pair of opposed side walls;

a hold defined within said deck and said inner shell;

an automatic valve operatively associated with said inner shell for permitting the selective flow of fluids between said water cushion space and said hold;

a charging and discharging port for controlling the flow of water into said water cushion space;

a flexible, oil-holding bladder disposed within said hold;

an oil receiving port fitted to said deck for permitting fluid communication of oil into and out of said bladder; and means for selectively lifting said bladder off of said floor and at least partially away from said pair of opposed side walls.

2. The bladder-type multipurpose vessel of claim 1, further including a reserve bladder and a reserve bladder lifting cable.

3. A bladder-type multipurpose vessel operable to transport oil, water or solid cargo and including both rigid and flexible construction, the comprising:

an outer shell;

an inner shell, said outer shell and said inner shell being operatively related;

a fluid cushion area defined between said inner shell and said outer shell;

a hold substantially defined by said inner shell, said shell including a floor and a pair of opposed side walls;

a fluid bladder substantially fitted within said hold;

a fluid cushion area defined between said fluid bladder and said inner shell;

a fluid delivery pipeline;

a plurality of fluid regulating valves; and means for selectively lifting said bladder off of said floor and at least partially away from said pair of opposed side walls.

4. The bladder-type multipurpose vessel of claim 3, wherein said fluid cushion area is a water cushion, said vessel further including a water charging and discharging port operatively associated with said water cushion.

5. The bladder-type multipurpose vessel of claim 3, further including an upper deck and a water-spraying spray pipe operatively associated therewith, said spray pipe being operable to provide water moisture to said bladder.

6. The bladder-type multipurpose vessel of claim 3, wherein said bladder is composed of a multi-tiered, lightweight, high strength and hermetic material, said tiers including an antistatic, oil-resistant inner tier, a reinforced hermetic intermediate tier, and a waterproof hermetic outer tier, between each adjacent tier there being provided at least one discontinuous, grid-like adhesive layer in association with several continuous adhesive layers, each of said tiers being coated with a hermetic coating, said bladder being foldable.

7. The bladder-type multipurpose vessel of claim 6, wherein said bladder is composed of a flexible material, said bladder being movable from a substantially expanded position within and relative to said hold when filled with oil to a substantially contracted position within and relative to said hold when said hold is substantially filled with water when the vessel is used for water transport.

8. The bladder-type multipurpose vessel of claim 6, wherein said means for selectively lifting includes a bladder lifting cable, said hold including an upper portion and wherein said bladder is fixed to said upper portion of said hold by said bladder lifting cable, whereby when the vessel is in its oil carrying mode standing water may be in said hold, and whereby the vessel may be converted to use for the carrying of cargo by the removal of said standing water through said charging and discharging port and said lifting of said bladder by said bladder lifting cable.

9. The bladder-type multipurpose vessel of claim 3, wherein said means for selectively lifting includes a lifting cable being disposed within and attached to said bladder, a reserve bladder having a folding crease, and a reserve bladder-lifting cable, said reserve bladder and said reserve bladder-lifting cable being disposed within said hold, said bladder including a side wall, said side wall having a bottom, and said reserve bladder-lifting cable being provided at said bottom of said side wall of said bladder and above said folding crease of said reserve bladder, said reserve bladder being provided with an oil resistant adhesive of low strength at said folding crease, said reserve bladder being movable from a resting folded state to an extended protective state.

10. The bladder-type multipurpose vessel of claim 9, wherein said means for selectively lifting includes a bladder lifting cable, said hold including an upper portion and wherein said bladder is fixed to said upper portion of said hold by said bladder lifting cable, whereby when the vessel is in its oil carrying mode standing water may be in said hold, and whereby the vessel may be converted to use for the carrying of cargo by the removal of said standing water through said charging and discharging port and said lifting of said bladder by said bladder lifting cable.

11. The bladder-type multipurpose vessel of claim 3, wherein said hold includes an upper part, said vessel further including an oil-receiving port, a scavenging port and a fire-fighting nozzle operatively associated with said upper part of said hold, whereby in the event that oil is being off-loaded, water is allowed to enter said hold to apply pressure on the oil through said bladder such that said bladder and the oil is pushed upward effecting discharge of the oil from said hold.

12. The bladder-type multipurpose vessel of claim 11, wherein said hold includes an intermediate part, said oil-receiving port, said oil-scavenging port, and said fire-fighting nozzle extending substantially between said upper part and said intermediate part, the vessel further including blocking rails disposed around said oil-receiving port, said oil-scavenging port, and said fire-fighting nozzle to prevent said bladder from being drawn into said scavenging port.

13. The bladder-type multipurpose vessel of claim 3, wherein said bladder is composed of a flexible material, said bladder being movable from a substantially expanded position within and relative to said hold when filled with oil to a substantially contracted position within and relative to said hold when said hold is substantially filled with water when the vessel is used for water transport.

14. The bladder-type multipurpose vessel of claim 3, wherein said means for selectively lifting includes a bladder lifting cable, said hold including an upper portion and wherein said bladder is fixed to said upper portion of said hold by said bladder lifting cable, whereby when the vessel is in its oil carrying mode standing water may be in said hold, and whereby the vessel may be converted to use for the carrying of cargo by the removal of said standing water through said charging and discharging port and said lifting of said bladder by said bladder lifting cable.

* * * * *